US009854895B2

(12) United States Patent
Pires et al.

(10) Patent No.: US 9,854,895 B2
(45) Date of Patent: Jan. 2, 2018

(54) COSMETIC APPLICATOR

(71) Applicant: Zen Design Solutions Limited, Kowloon (HK)

(72) Inventors: Leo Clifford Pires, Basking Ridge, NJ (US); Roger Hwang, Maple (CA); Rahul Bose, New Delhi (IN); Iti Seth, Faridabad (IN); Smita Srivastava, New Delhi (IN); Rajesh Deswal, Rohtak (IN)

(73) Assignee: ZEN DESIGN SOLUTIONS LIMITED, Kowloon, Hong Kong (CN)

( * ) Notice: Subject to any disclaimer, the term of this patent is extended or adjusted under 35 U.S.C. 154(b) by 131 days.

(21) Appl. No.: 14/957,689

(22) Filed: Dec. 3, 2015

(65) Prior Publication Data

US 2016/0157586 A1 Jun. 9, 2016

(30) Foreign Application Priority Data

Dec. 8, 2014 (IN) ..... 3576/DEL/2014

(51) Int. Cl.
*A45D 40/26* (2006.01)
*A46B 9/02* (2006.01)

(52) U.S. Cl.
CPC ..... *A45D 40/265* (2013.01); *A45D 40/26* (2013.01); *A46B 9/021* (2013.01); *A46B 2200/1053* (2013.01)

(58) Field of Classification Search
CPC .... A45D 40/265; A45D 40/26; A45D 40/262; A45D 40/267; A46B 9/021; A46B 9/028; A46B 2200/1053; A46B 2200/1046; A46B 2200/106
See application file for complete search history.

(56) References Cited

U.S. PATENT DOCUMENTS

| | | | | |
|---|---|---|---|---|
| 8,042,555 | B2 * | 10/2011 | Neuner | A45D 40/265 132/218 |
| 8,448,650 | B2 | 5/2013 | Higgins | |
| 2010/0288296 | A1 * | 11/2010 | Takata | A45D 40/262 132/218 |
| 2011/0168204 | A1 * | 7/2011 | Gueret | A45D 40/265 132/218 |
| 2012/0294664 | A1 * | 11/2012 | Gueret | A46B 9/021 401/118 |
| 2013/0319451 | A1 * | 12/2013 | Viegas | A45D 40/262 132/218 |
| 2015/0320177 | A1 * | 11/2015 | Pires | A46B 9/021 401/129 |

* cited by examiner

*Primary Examiner* — Rachel Steitz
(74) *Attorney, Agent, or Firm* — Patterson + Sheridan, LLP

(57) ABSTRACT

A cosmetic applicator for applying a composition, the cosmetic applicator comprising a rod having a central longitudinal axis and a distal end of the rod is connected to an applicator head. The applicator head comprises a molded core and a plurality of tines projecting outwardly from the core. The core is elongated along a central longitudinal axis which does not coincide or intersect with the central longitudinal axis of the rod. The core further includes at least one longitudinal spline running along the central longitudinal axis of the core for entire length of the core, the at least one longitudinal spline is free of tines and wherein an end of the spline of the core contacts an outer edge of a transition portion of the applicator head.

20 Claims, 11 Drawing Sheets

COSMETIC APPLICATOR

CROSS-REFERENCE TO RELATED APPLICATION

This application claims benefit of Indian Provisional Application Ser. No. 3576/DEL/2014, filed Dec. 8, 2014, which is incorporated by reference in its entirety.

BACKGROUND

Field of the Invention

Embodiments of the present disclosure relate to a cosmetic applicator for applying a cosmetic, makeup, or personal care composition e.g. mascara to eyelashes or eyebrows. More particularly, the disclosure, relates to an applicator including a molded applicator head with a core and a plurality of application elements that are carried by the core.

Description of the Related Art

An applicator such as a mascara applicator must perform several functions. First, the applicator must accumulate mascara within the bottle, and carry the mascara through the wiper, which removes the excess mascara from its bristles. The mascara applicator must then apply the mascara to the eyelashes. Preferably, the mascara applicator should be capable of one or more additional functions, including, curling or lifting the eyelashes, and/or combing and separating the eyelashes, as well as spreading the mascara relatively evenly thereon. Desirably the mascara applicator must be capable of more precise applications such as application of mascara to the smaller, bottom lashes, the corners of the lashes, and general touch-up. In all these functions, the mascara applicator must be comfortable for the consumer to use.

Conventional mascara applicators generally include a brush having a twisted wire core and a bristle portion. The bristle portion generally includes a number of uniformly sized bristles spaced evenly throughout its length. Although these applicators are generally capable of depositing mascara onto the eyelashes, they do not facilitate application of the composition to all eyelashes in an accurate or detailed manner. Therefore, a user must carry a variety of applicators or must manipulate the brush in an unnatural direction to cover the eyelashes. Due to the nature of production technique, the design options for forming and arrangement of the bristles have been limited.

In case of molded mascara applicators that are produced by injection molding, a very extensive variety of design options exists.

U.S. Pat. No. 8,042,555 discloses an applicator which is a single-piece molded unit formed of a single material and includes a slim, tapered head portion, having an arcuate configuration. The head portion comprises a support and at least two rows of projecting tines integrally molded therewith. The tines extend transversely away from one side of the support relative to the longitudinal axis of the head, the opposite side of the support being smooth and free from tines.

U.S. Pat. No. 8,448,650 discloses an applicator which includes an applicator element comprising a cylindrical molded plastic body and three sections—a large section, a medium section, and a small section. Each section comprises an array of bristles arranged radially in a generally ovoid or sphere-like pattern, with shorter bristles toward the end of each section and longer bristles toward the middle each section.

There is a need to further improve the applicators for applying a composition, in particular mascara, to the eyelashes or eyebrows, in order to improve their performance, in particular to give the applicator greater lengthening, curling and combing power, and to do so while enabling a satisfactory quantity of composition to be loaded onto the applicator, and requiring hand movements in use that are easy to perform.

SUMMARY

In accordance with the foregoing objectives and others, the present disclosure provides an applicator for applying a cosmetic, makeup, or personal care composition. The composition includes lip gloss, mascara, eye liner, hair color, wound care, pharmaceutical and like products. More particularly, the present disclosure relates to a cosmetic applicator for applying mascara to eyelashes or eyebrows.

The cosmetic applicator includes a rod and an applicator head which is attached directly or indirectly to a distal end of the rod.

According to an aspect of the present disclosure, a cosmetic package is provided, the cosmetic package comprising a container for containing a cosmetic composition and a cosmetic applicator in accordance with the disclosure. The cosmetic composition may be used for application to the eyelashes and/or the eyebrows, e.g. mascara or a care product.

According to an embodiment of the disclosure, the cosmetic applicator comprises a rod having a central longitudinal axis and wherein a proximal end of the rod is connected to a closure cap while the distal end of the rod is connected to the applicator head. The applicator head comprises a molded core and a plurality of application elements projecting outwardly from the core. The application elements are selected from a group consisting of tines, bristles, fibers, flock and the like.

According to yet another embodiment of the disclosure, the applicator head further includes a transition portion which serves to isolate the core from the rod or a mounting post. The transition portion of the applicator head is of similar cross-section as that of the rod and rests at the distal end of the rod.

According to an embodiment of the disclosure, the core is off-centered with respect to the central longitudinal axis of the rod. The core is elongated along a central longitudinal axis, wherein the central longitudinal axis of the core does not coincide or intersect with the central longitudinal axis of the rod at any point on the core. Such a configuration may for example improve the application by facilitating handling of the cosmetic applicator and enables the core to carry extra long application elements.

According to an embodiment of the disclosure, the central longitudinal axis of the core comprises at least two concave curvatures that are opposite in direction to each other so as to impart an s-shaped curvature to the central longitudinal axis of the core. The central longitudinal axis of the core comprises at least two curves namely a first curve and a second curve such that a concave side of the first curve faces the central longitudinal axis of the rod and a concave side of the second curve faces away from the central longitudinal axis of the rod so as to impart an s-shaped curvature to the central longitudinal axis of the core.

According to another embodiment of the disclosure, the central longitudinal axis of the core may be substantially parallel to the central longitudinal axis of the rod.

According to an embodiment of the disclosure, the core may have a variable cross-section, measured perpendicularly to its longitudinal axis, with varying shape as one moves along the central longitudinal axis of the core. Preferably, the core tapers towards a distal end of the applicator head. The core may have a non-circular cross-section over a major portion of its length. According to a preferred embodiment, the core may have a bi-lateral symmetry and its transverse cross sections do not show a radial symmetry. However, in alternate embodiments, at least one of the transverse cross sections of the core may have radial symmetry.

According to another embodiment, the shape of the cross-section of the core may for example be selected from following list which is non-limiting: oval, elliptic, oblong, triangular, square, rectangular, pentagonal, hexagonal or octagonal shapes.

According to another embodiment, the core comprises at least two faces opposite to each other. The at least two faces comprises a first face and a second face. The first face is an application face and comprises application elements. The second face may or may not comprise application elements.

According to another embodiment, the first face comprises a deflection region towards the distal end of the core.

According to yet another embodiment of the disclosure, the core presents at least one longitudinal spline running along the central longitudinal axis of the core for substantially the entire length of the core and wherein a proximal end of the spline contacts an outer edge of a transition portion of the applicator head. According to an alternate embodiment, a proximal end of the spline flushes with a peripheral surface of the transition portion of the applicator head. The spline has a substantial width and is free of application elements. Preferably, the width of the spline reduces in value towards the distal end of the applicator head. The width of the spline in any portion of the core is always less than half of value of a perimeter of the core at that portion of the core. The spline comprises a convex curve followed by a concave curve from a proximal end to a distal end of the spline and the spline of the core thus exhibits an S-shaped curvature. Further, radius of curvature of the convex curve of the spline is greater than the radius of curvature of the concave curve.

The term "spline" as used herein is a portion of an outer surface of the core that contacts/starts from an outer edge of a transition portion of the applicator head and extends in a longitudinal direction to a distal end of the core; and is free of application elements.

According to an aspect of the present embodiment, the core has a thickness that increases, and then decreases, from a proximal end of the core towards a distal end of the core, and defines a maximum thickness at about one third of the length of the core.

According to yet another embodiment of the disclosure, a major portion of the core excluding the longitudinal spline includes a plurality of application elements for holding and releasing a cosmetic composition, such as mascara. The application elements may comprise any suitable surface (e.g., textured or smooth) capable of holding and transferring a charge of the cosmetic composition. Moreover, the application elements may also be capable of imparting various types of aesthetically pleasing appearances to the eyelashes, such as a volumized appearance, a separated appearance (i.e., the eyelashes being individually separated from each other), a curly appearance, etc. The application elements of the applicator head extend in longitudinal rows along the longitudinal axis of the core along major part of its length.

According to yet another embodiment of the disclosure, the application elements are tines wherein the tines may be formed so that some or all of the tines have a varying diameter, length, or cross-sectional shape. For example, some tines may have one diameter, length, and/or shape and other tines may have another diameter, length and/or shape. Also, the cross-sectional shape or diameter of individual tines may change along their length. The tines may be, without limitation, integral with the molded core or may be synthetic or natural fibers implanted therein. The shape of the tines employed will be determined by the desired degree of stiffness/flexibility, payoff, loading, and other desired application characteristics. The cross-sectional shape of the tines may be, for example, cylindrical, diamond-shaped or ellipsoid.

According to an embodiment of the present disclosure, the rows of tines are arranged in a manner such that an envelope shape formed by tips of the tines has a tri-lobed profile i.e. free ends of tines form three ovoid or spherical appearance sections on the applicator head along the longitudinal axis of the application head. The tines vary in length in a row and the longest tine in each ovoid section lie in middle of that section with shorter tines toward the end of each section, such that each section approximates a sphere-like shape. All tines are regularly spaced in a row. The sections are adapted to engage with different portions of a user's eyelashes to improve application of a cosmetic composition. The applicator head include a small section, a medium section, and a large section for applying a cosmetic composition such as mascara to the small, medium and large eyelashes respectively. Such applicator allows for improved application of a cosmetic composition, such as by a single stroke. The large section is adapted to engage with the longest eyelashes located towards the middle of the user's eye. The medium section is adapted to engage with the medium length eyelashes and similarly the small section is adapted to engage with the shortest eyelashes located towards the inner corner of the user's eye. However, the envelope shape is not restricted to tri-lobed profile and the tines may be selected and arranged in different possible manners in order to achieve different envelope shapes. Alternately, the tines may be replaced by other type of application elements like bristles, flock and the like.

According to another embodiment, the applicator head comprises tines of at least two different shapes. According to another embodiment, at least one row of tines of the applicator head comprises of regularly spaced tines having a single tip or at least two tips. According to another embodiment, at least one row of tines of the applicator head comprises of a tine with a single tip followed by a tine with two tips.

The applicator head may be formed by a bi-injection molding process. The bi-injected applicator head comprises two parts, namely a first applicator part and a second applicator part which are bi-injection molded as a single unit. The process of bi-injection molding is a well known process which allows two or more materials to be substantially simultaneously injected into a single mold to obtain a single integrally formed component. The first applicator part and the second applicator part may be formed of two different materials. A part of the core along with tines thereon, transition portion and mounting post which constitute the first applicator part are fabricated using a first material. Similarly, another part of the core along with tines thereon, transition portion and mounting post which constitute the second applicator part are fabricated using a second material which is different from the first material. The two materials differ in physical and/or chemical properties. The first material and the second material may have different chemical nature or they may have same chemical nature but have different color and/or texture and/or hardness.

As used herein, the term 'same chemical nature' means that the at least two materials may belong to a same family of polymer, for example an elastomer or a thermoplastic elastomer. Within a family they may correspond to polymers obtained from the same monomer or type of monomer, or the same monomers or same type of monomers, being in this case copolymers. The copolymers of the same chemical nature may differ by the special distribution of the monomers, being alternating or statistical copolymers, and/or by the proportions of the monomers in the copolymers. Within a family, the at least two materials may correspond to polymers having a same backbone with different and/or identical lateral chains and/or substituents. Within a family they may correspond to different grades, for example to different degree of cross linking and/or a different degree of polymerization. The at least two materials may differ by their additive(s) and/or plasticizer(s), and/or may comprise a same additive and/or plasticizer in different quantity.

The at least two materials may each comprise the two same polymers, but in different proportions, having different hardnesses. The two materials may be e.g. two polyester, having different hardnesses, for example Hytrel® 40 Shore A and Hytrel.degree. 70 Shore A, for example two polyether block amide such as two different grades of PEBAX®, or two different polyolefins, for example with the same number of carbons, or two different polyamides, for example two grades of Nylon®. The use of at least two materials of the same chemical nature may facilitate the molding of the cosmetic applicator, the compatibility between the at least two materials being greater due to their same chemical nature.

According to another embodiment of the disclosure, the at least two materials may have properties that are attractive and non-attractive to mascara, have different stiffness, have different tactile feel, have different color, have different chemical nature, have different magnetic property, have different temperature property and/or other property.

According to an embodiment of the present disclosure, the first applicator part is fabricated from the first material which is softer than the second material from which the second applicator part is fabricated. In another embodiment, the first applicator part is fabricated from the first material having a hardness of less than about 80 Shore D scale (ShD). In another embodiment, the second applicator part is fabricated from the second material having a hardness of greater than about 20 Shore D scale (ShD). It is also contemplated that the first material of the first applicator part may be harder than the second material of the second applicator part. The hard material has been found to provide separation of the lashes during the application of mascara, while the softer material provides lift and volume.

In an alternate embodiment of the present disclosure, the first applicator part and the second applicator part of the applicator head may be two separate parts which may be coupled together to obtain the applicator head of the present disclosure. The first applicator part and the second applicator part may be formed of two different materials. The core and tines which constitute the first applicator part are formed by integrally injection-molding using a first material. Similarly, the core and tines which constitute the second applicator part are formed by integrally injection-molding using a second material. The first applicator part and the second applicator part may be coupled to each other by any known affixation means or mechanisms, either mechanical like snap fit, threaded engagement or adhesive-based.

According to an alternate embodiment of the present disclosure, the tines may be covered by a flock coating.

According to yet another embodiment of the present disclosure, at least some of the tines of at least one of the first applicator part and the second applicator part may be flocked.

According to an alternate embodiment of the present disclosure, the applicator head of the present disclosure may be manufactured as a single molded unit comprising a single material by using any suitable methods known in art such as injection molding.

According to an embodiment of the present disclosure, the core and tines may be molded integrally of any suitable material, for example a plastic material, such as a thermoplastic polyester elastomer, a thermoplastic polyurethane elastomer, or compound thermoplastic materials including SBS or SEBS. Molding materials may also include antibacterial agents, for example Triclosan® and/or product performance-enhancing and/or shelf-life-enhancing agents, such as plasticizers to improve flexibility and reduce the occurrence of cracking over time, and fluorination agents to provide a barrier layer over hygroscopic plastics.

According to an embodiment of the disclosure, the rod presents a cross-section that is circular, but it would not be beyond the ambit of the present disclosure for the rod to present some other section. The longitudinal axis of the rod is rectilinear and coincides with the longitudinal axis of the container when the cosmetic applicator is in place thereon, but it would not be beyond the ambit of the present disclosure for the rod to be non-rectilinear, e.g. forming a bend.

According to yet another embodiment of the disclosure, the applicator head of the cosmetic applicator can be secured to the rod by means of mechanical and/or adhesive connection. According to preferred embodiment of the present disclosure, the applicator head may include a mounting post which is integrally molded with the applicator head and enable it to be fastened in the rod. The mounting post may be fastened by force-fitting, in particular snap-fastening, by adhesive, by heat-sealing, or by crimping in a corresponding housing provided at the distal end of the rod.

Although the present disclosure has been described herein with reference to particular embodiments, it is to be understood that these embodiments are merely illustrative of certain principles and applications of the present disclosure. It is further to be understood that numerous modifications may be made to the illustrative embodiments and that other arrangements may be devised without departing from the present disclosure.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

Figure 1:
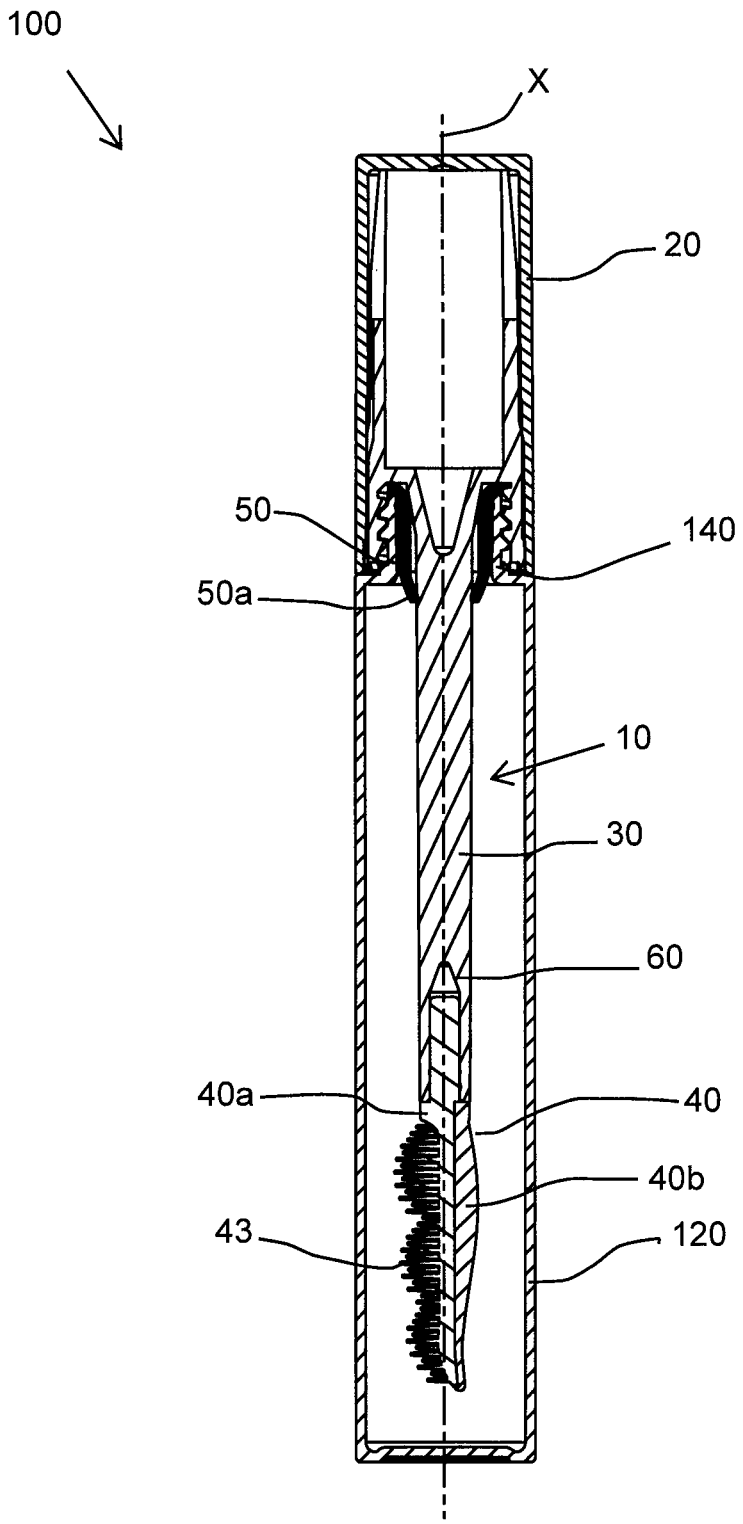
FIG. 1 illustrates a sectional view of a cosmetic applicator of the present disclosure as used within a cosmetic package.

To facilitate understanding, identical reference numerals have been used, where possible, to designate identical elements that are common to the figures. It is to be noted, however, that the appended drawings illustrate only typical embodiments of this disclosure and are therefore not to be considered limiting of its scope, for the disclosure may admit to other equally effective embodiments.

DETAILED DESCRIPTION

A cosmetic package 100 as seen in FIG. 1 comprises a container 120 for containing a cosmetic composition (not shown) and a cosmetic applicator 10 in accordance with the present disclosure. The cosmetic composition may be used for application to the eyelashes and/or the eyebrows, e.g. mascara or a care product. In the embodiment under consideration, the container 120 includes a threaded neck 140, and the cosmetic applicator 10 includes a closure cap 20 that is arranged to be fastened on the threaded neck 140 so as to close the container 120 in leak tight manner when not in use. The closure cap 20 also constituting a handle for the cosmetic applicator 10. Other means known in the art for attaching cap 20 to container's neck 140 may also be used with the same result, for example, a snap closure, or a lug style closure.

Figure 2A:
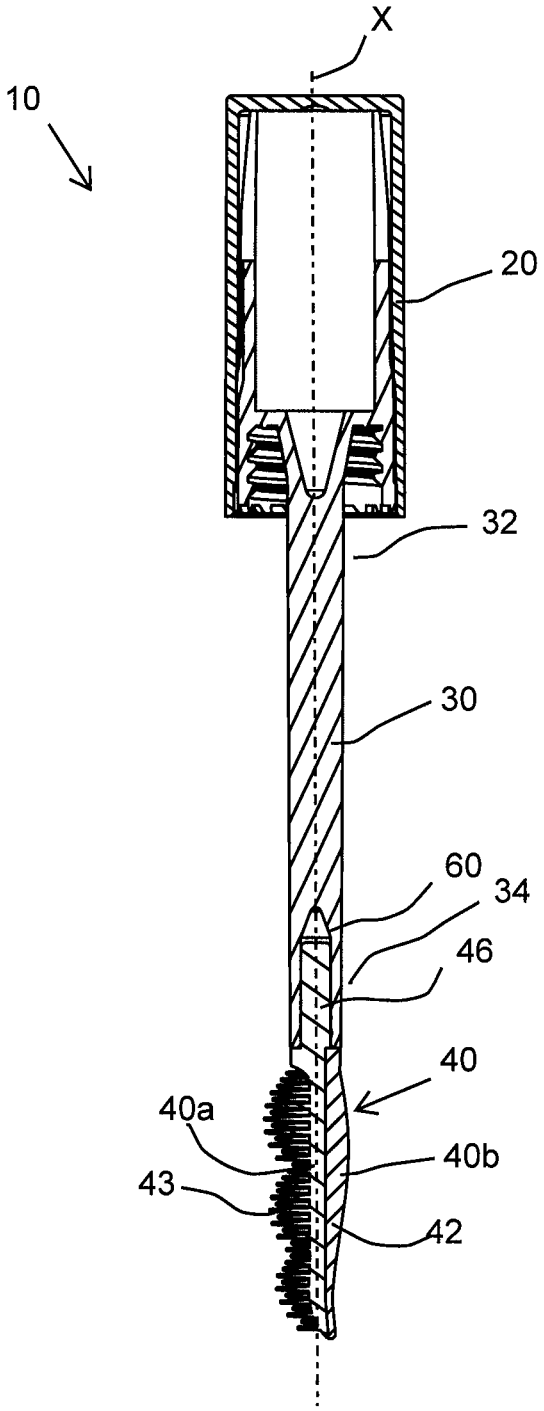
FIG. 2A is a cross-sectional view of the cosmetic applicator of FIG. 1.
Figure 2B:
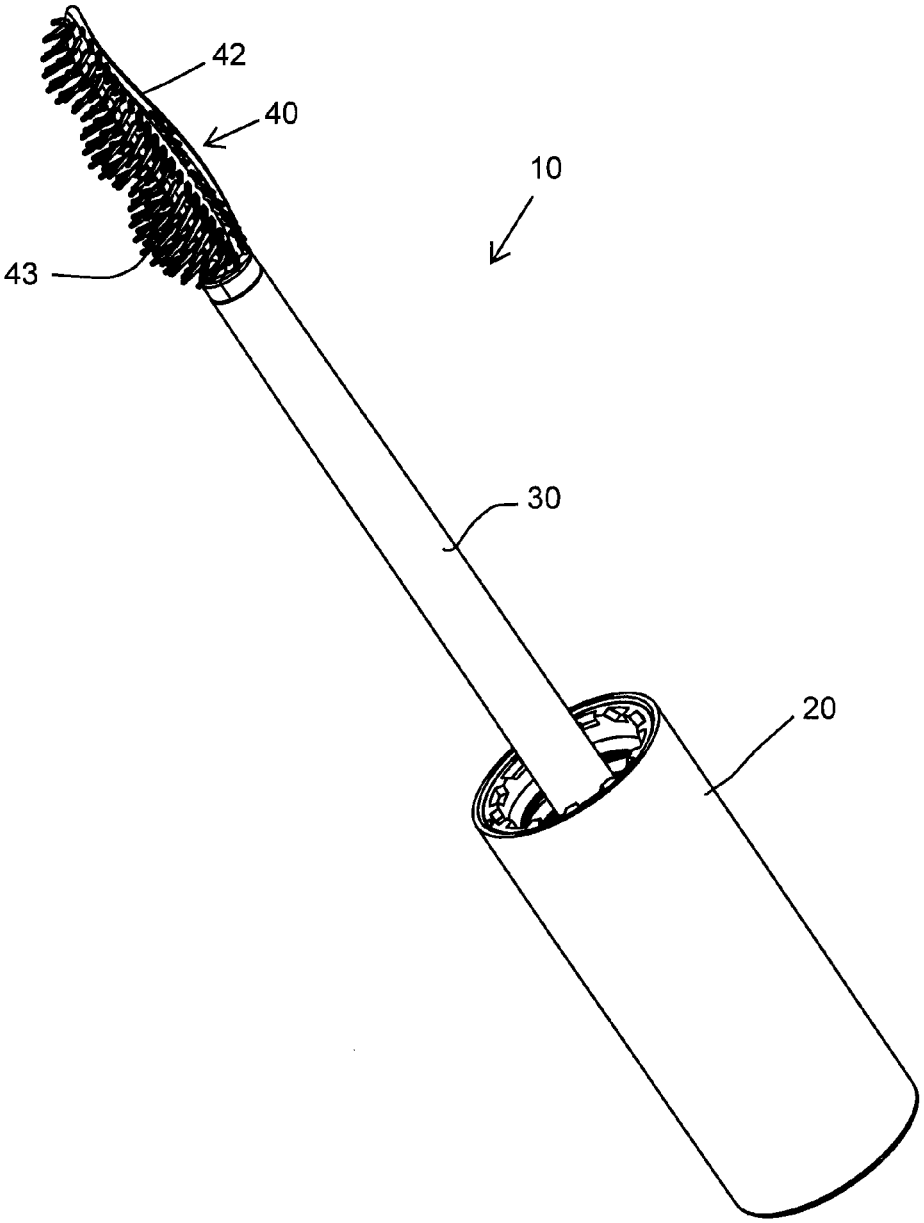
FIG. 2B is a perspective view of the cosmetic applicator of FIG. 1.

As seen in FIGS. 1-2B, the cosmetic applicator 10 comprises a rod 30 having a central longitudinal axis X and wherein a proximal end 32 of the rod 30 is connected to the closure cap 20 while a distal end 34 of the rod 30 is connected to an applicator head 40. The applicator head 40 comprises a molded core/support 42 and a plurality of application elements for example tines 43 projecting outwardly from the core 42. The application elements may also include bristles, flock and the like.

The container 120 may include a wiper member 50 inserted into the neck 140 for wiping the applicator head 40 and rod 30 when the cosmetic applicator 10 is being removed from the container 120. The wiper member 50 that may be of any type includes a lip 50*a* that is arranged to wipe the rod 30 and the applicator head 40 while the cosmetic applicator 10 is being removed from the container 120. The lip 50*a* defines a wiper orifice of diameter that is adapted to a diameter of the rod 30.

In the embodiment shown, the rod 30 presents a cross-section that is circular, but it would not be beyond the ambit of the present disclosure for the rod 30 to present some other cross-section. The wiper member 50 could be adapted to the shape of the rod 30 and to the shape of the applicator head 40, where appropriate.

In the embodiment under consideration, the central longitudinal axis X of the rod 30 is rectilinear and coincides with a longitudinal axis of the container 120 when the cosmetic applicator 10 is in place thereon, but it would not be beyond the ambit of the present disclosure for the rod 30 to be non-rectilinear, e.g. forming a bend.

The applicator head 40 of the cosmetic applicator 10 can be secured to the rod 30 by means of mechanical and/or adhesive connection. As shown in FIG. 2A, the applicator head 40 may include a mounting post 46 which is integrally molded with the applicator head 40 enabling it to be fastened in the rod 30. The mounting post 46 is circularly symmetrical, being of circular cross-section, but it could be of some other shape. In particular, the mounting post 46 may be fastened by staking, force-fitting, in particular snap-fastening, by adhesive, by heat-sealing, or by crimping in a corresponding bore 60 provided at the distal end 34 of the rod 30.

In the embodiment under consideration, the applicator head 40, as shown in FIGS. 3A-3D, incorporates a mounting means including an annular bead 44 located along the mounting post 46 which allows the applicator head 40 to be mounted without orientation to the rod 30 and which prevents the applicator head 40 from pulling out from the rod 30. The mounting post 46 of the applicator head 40 may be physically snapped into shallow bore 60 in rod 30 as shown in FIG. 2A and/or rod 30 can be crimped on mounting post 46.

In the embodiment under consideration, the applicator head 40 further includes a transition portion 48 which serves to isolate the core 42 from the rod 30 or the mounting post 46.

Figure 4A:
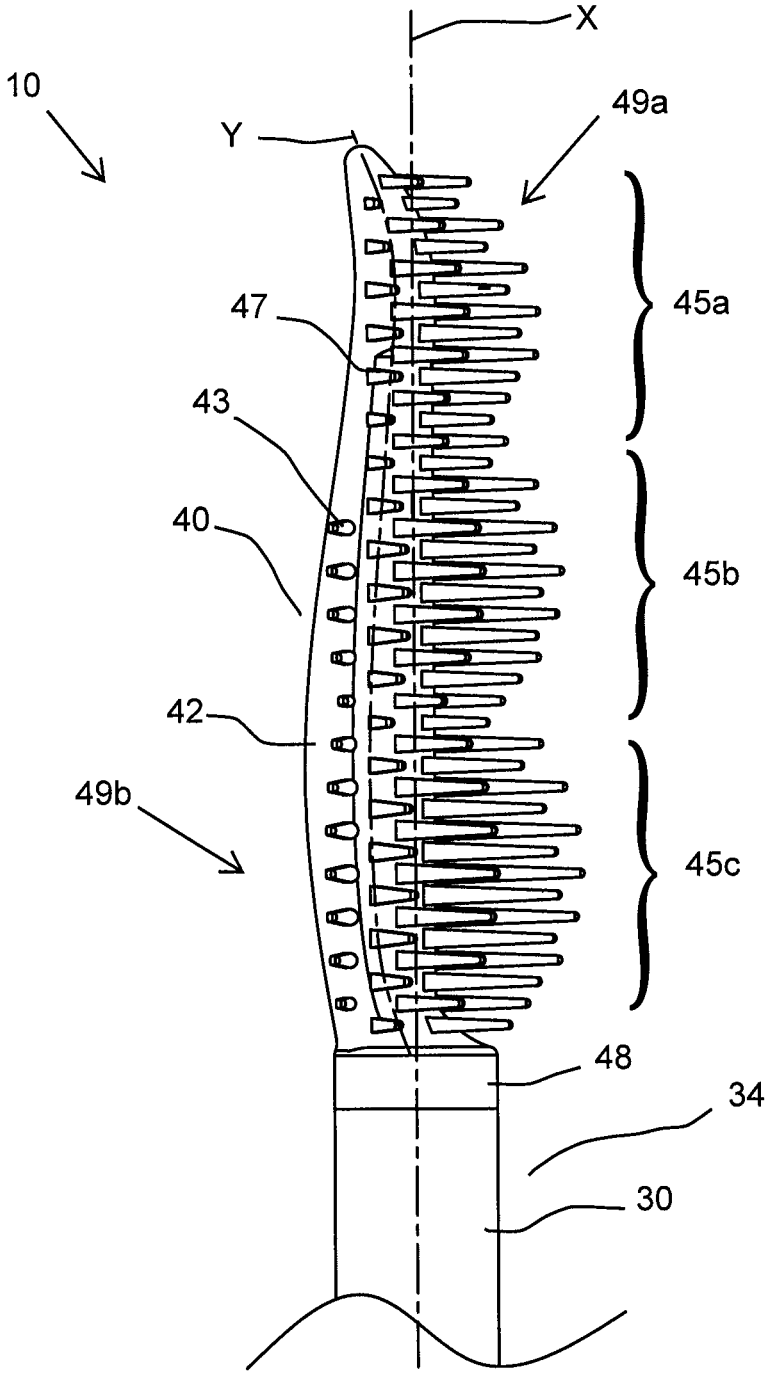
FIG. 4A is a left side view of a portion of the cosmetic applicator of FIG. 2B.
Figure 4B:
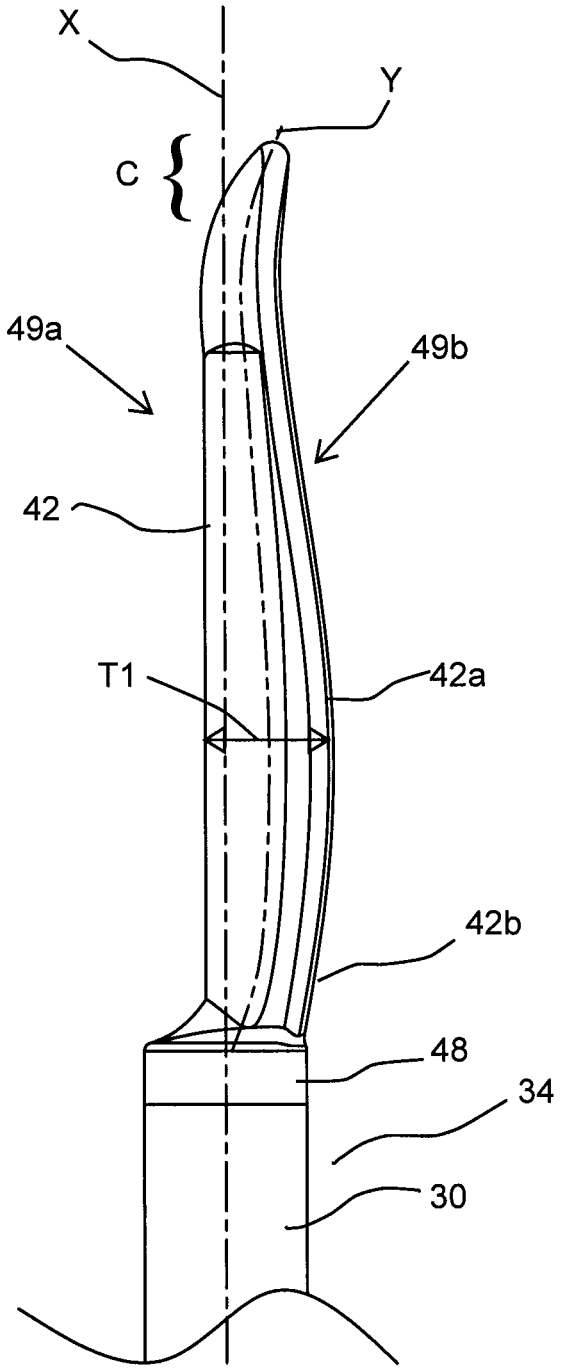
FIG. 4B is a right side view of a portion of the cosmetic applicator of FIG. 2B devoid of tines.

With reference to FIG. 4A and FIG. 4B, it can be seen that the transition portion 48 is of similar cross-section as that of the rod 30 and rests at the distal end 34 of the rod 30. The core 42 is of an elongate shape and is off-centered with respect to the rod 30 such that a central longitudinal axis Y of the core 42 does not coincide or intersect with the central longitudinal axis X of the rod 30. Such a configuration may for example improve the application by facilitating handling of the cosmetic applicator 10 and enabling the core 42 to carry extra-long tines with good cosmetic composition retaining capabilities. Further, the central longitudinal axis Y of the core 42 comprises at least two concave curvatures that are opposite in direction to each other so as to impart an s-shaped curvature to the central longitudinal axis Y. The central longitudinal axis Y of the core 42 comprises at least two curves namely a first curve and a second curve such that a concave side of the first curve faces the central longitudinal axis X of the rod 30 and a concave side of the second curve faces away from the central longitudinal axis X of the rod 30. In the embodiment under consideration, the central longitudinal axis Y of the core 42 is curved but it is within ambit of the present disclosure that the longitudinal axis Y of the core 42 may be substantially parallel to longitudinal axis X of the rod 30. The core 42 comprises at least two faces opposite to each other. The at least two faces comprises a first face 49*a* and a second face 49*b*. The first face 49*a* is an application face and comprises application elements 43. The second face 49*b* may or may not comprise application elements. The first face 49*a* comprises a deflection region C towards the distal end of the core 42 such that the deflection region C is deflected away from the longitudinal axis X of the rod 30.

Figure 3A:
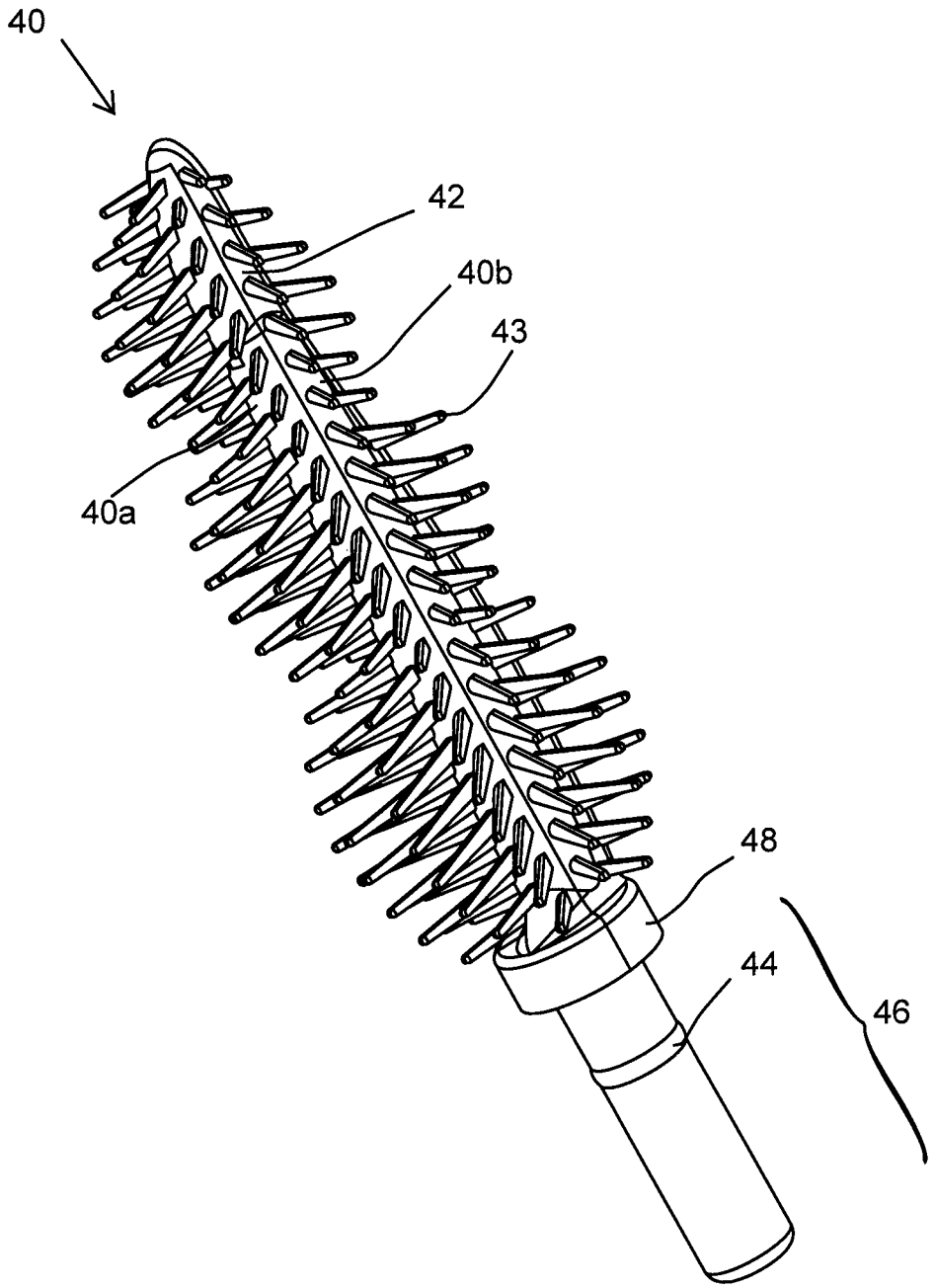
FIG. 3A is a perspective view of an applicator head of the cosmetic applicator of FIG. 2B.
Figure 3B:
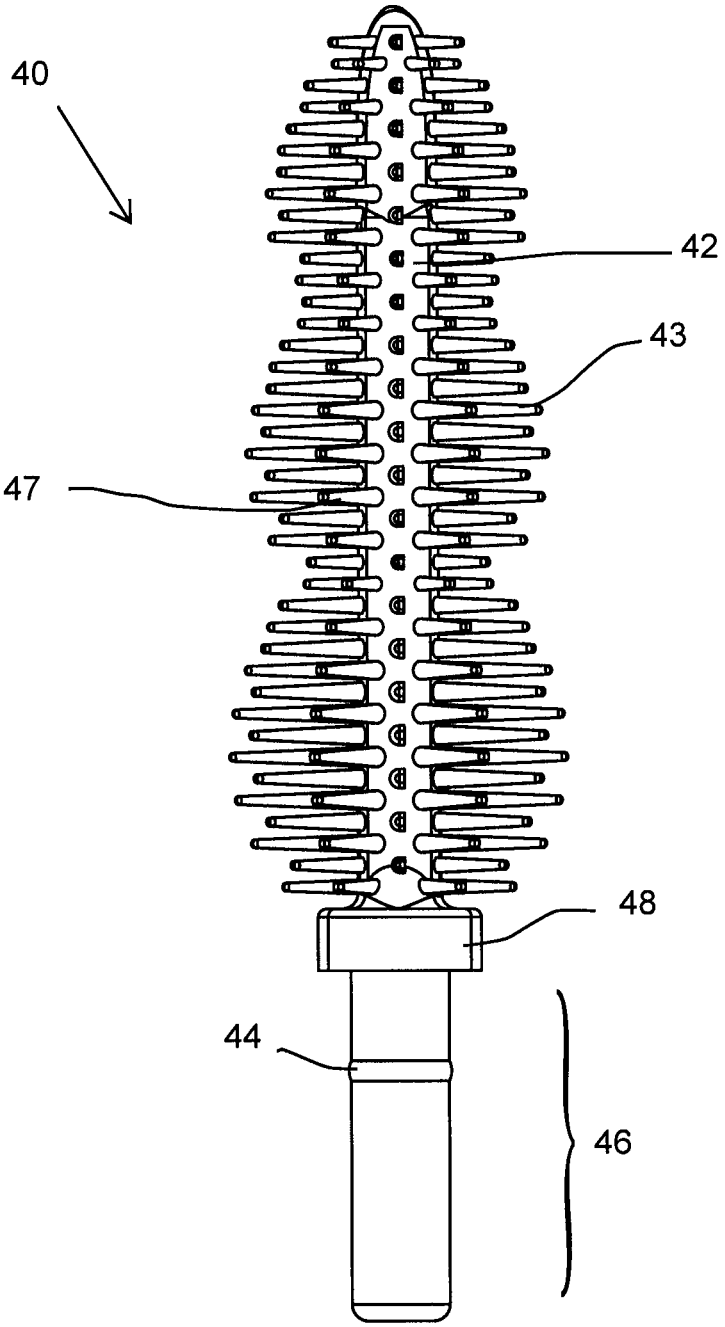
FIG. 3B is a front view of the applicator head of FIG. 3A.
Figure 3C:
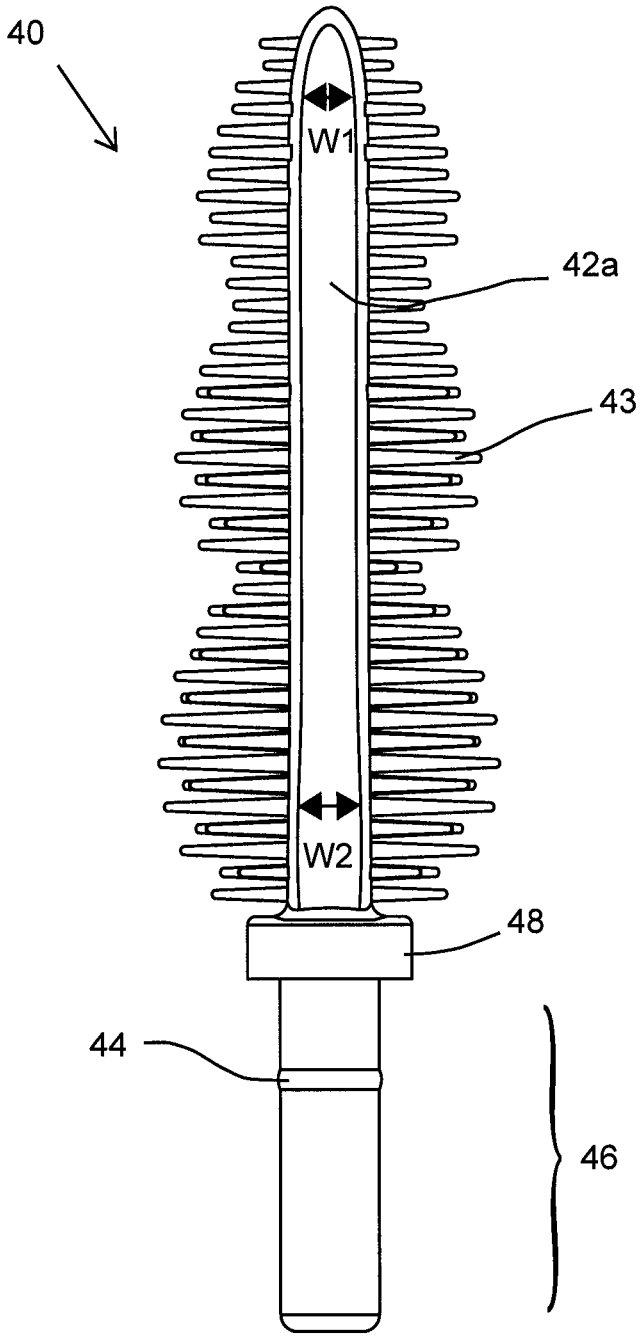
FIG. 3C is a rear view of the applicator head of FIG. 3A.
Figure 3D:
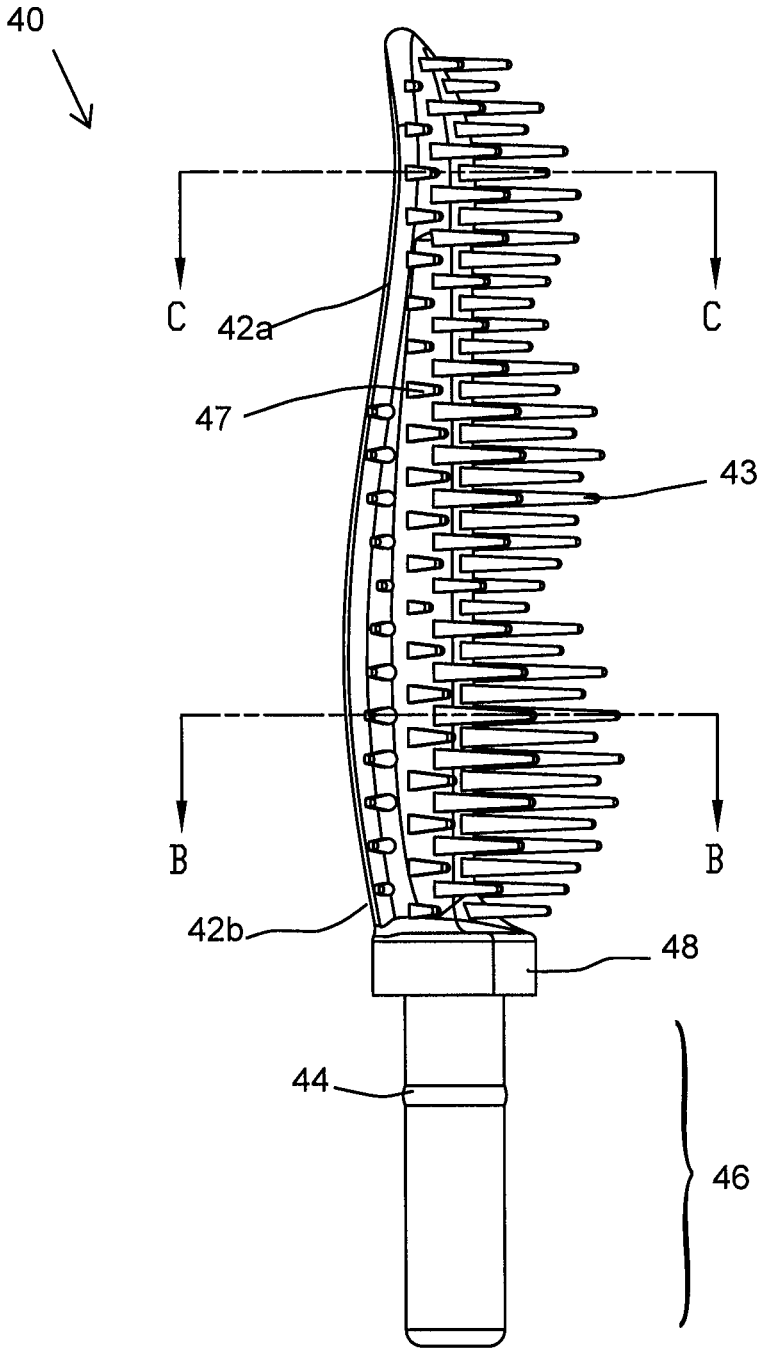
FIG. 3D is a left side view of the applicator head of FIG. 3A.
Figure 5A:
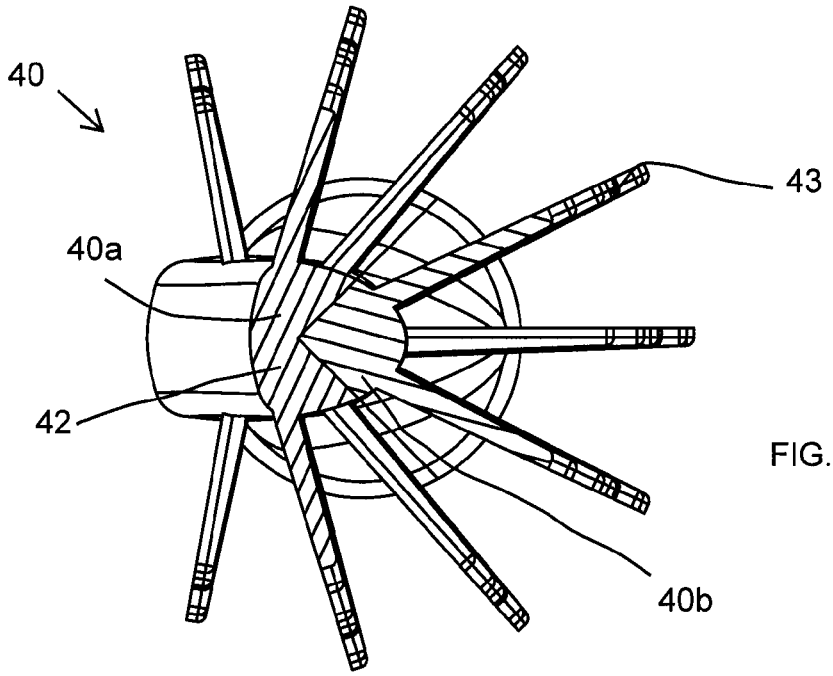
FIG. 5A is a cross-sectional view of the applicator head taken along line C-C of FIG. 3D.
Figure 5B:
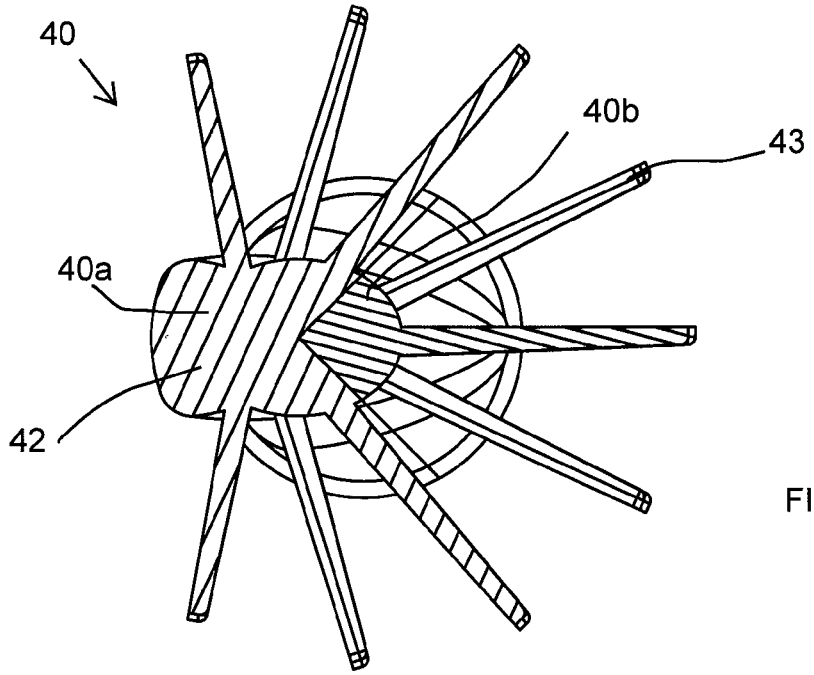
FIG. 5B is a cross-sectional view of the applicator head taken along line B-B of FIG. 3D.

FIG. 5A and FIG. 5B show cross-sectional view of the applicator head 40 of FIG. 3D taken along line C-C and B-B respectively. The core 42 has a non-circular cross-section over the major portion of its length. As shown in the FIGS. 5A and 5B, the core 42 has a variable transverse cross-section along the longitudinal axis Y over for example at least half of its length, or even three quarters or the whole of its length. Preferably, the core 42 tapers towards the distal end of the applicator head 40. According to the embodiment under consideration, the core 42 has a bi-lateral symmetry and transverse cross sections of the core 42 at any point of its length do not possess radial symmetry. For example, as seen in FIGS. 5A & 5B the transverse cross sections of the core 42 differ from each other in shape and the transverse cross sections do not show radial symmetry. In alternate embodiments of the present disclosure, at least one of the transverse cross sections of the core 42 may have a radial symmetry. The shape of the transverse cross-section of the core 42 may for example be selected from the following list which is non-limiting: oval, elliptic, oblong, triangular, square, rectangular, pentagonal, hexagonal or octagonal shapes.

In the embodiment under consideration, as seen in FIGS. 3C and 3D, the core 42 presents at least one longitudinal spline 42*a* running along the central longitudinal axis Y of the core 42 for substantially the entire length of the core 42. The longitudinal spline 42*a* has a substantial width which varies along the central longitudinal axis Y of the core 42 and the longitudinal spline 42*a* is free of tines 43. Preferably, the width of the spline 42*a* reduces towards a distal end of the applicator head 40. As seen in FIG. 3C, W1 is smaller than W2. The width of the spline at any point on the core 42 is always less than half of the value of the perimeter of the core 42 at that point. As seen in FIG. 3D, a proximal end 42*b* of the spline 42*a* of the core 42 contacts an outer edge of a transition portion 48 of the applicator head 40. According to an alternate embodiment, the proximal end 42*b* of the spline 42*a* of the core 42 flushes with a peripheral surface of the transition portion 48 of the core 42. Also, as seen in the FIGS. 3D-4B, the spline 42*a* comprises a convex curve followed by a concave curve from a proximal end to a distal end of the spline 42*a* and thus the spline 42*a* provides an s-shape curvature to a rear face of the applicator head 40 as seen in FIG. 4B. The radius of curvature of the convex curve of the spline 42*a* is greater than the radius of curvature of the concave curve of the spline 42*a*. Referring to FIG. 4B, the core 42 has a thickness that increases, and then decreases, from a proximal end of the core 42 towards a distal end of the core 42, and preferably defines a maximum thickness T1 at about one third of the length of the core 42.

Referring to FIGS. 3A-5B, a major portion of the core 42, excluding the spline 42*a* of the core 42, includes a plurality of application elements as tines 43 for holding and releasing a cosmetic composition, such as mascara. At least some of the tines 43 cover the core 42 in a substantially radial configuration. Typically, each tine 43 may be described as a projection from the core 42. The tines 43 may comprise any suitable surface (e.g., textured or smooth) capable of holding and transferring a charge of composition. Moreover, the tines 43 may also be capable of imparting various types of aesthetically pleasing appearances to the eyelashes, such as a volumized appearance, a separated appearance (i.e., the eyelashes being individually separated from each other), a curly appearance, etc. The tines 43 of the applicator head 40 extend in longitudinal rows 47 along the central longitudinal axis Y of the core 42 along major part of its length.

As discussed in detail below, the tines 43 may be formed so that some or all of the tines 43 have a varying diameter, length, or cross-sectional shape. For example, some tines 43 may have one diameter, length, and/or shape and other tines 43 may have another diameter, length and/or shape. Also, the cross-sectional shape or diameter of individual tines 43 may change along their length. The tines 43 may be, without limitation, integral with the molded core 42 or may be synthetic or natural fibers implanted therein. The shape of the tines 43 employed will be determined by the desired degree of stiffness/flexibility, payoff, loading, and other desired application characteristics. The cross-sectional shape of the tines 43 may be, for example, cylindrical, diamond-shaped or ellipsoid. The tines 43 may be replaced by other type of application elements selected from bristles, flock and the like.

The tines 43 in the plurality of rows 47 may be arranged alternately to achieve a variety of configurations for such purposes as enhancing lash-thickening, lash-lengthening and/or lash-separation effects incident to mascara application.

In the embodiment under consideration, and as shown in FIG. 4A, the rows 47 of tines 43 are arranged in a manner such that an envelope shape formed by the tips of the tines 43 has a tri-lobed profile i.e. free ends of tines 43 form three substantially ovoid or spherical appearance sections. The applicator head 40 include a small section 45*a*, medium section 45*b*, and large section 45*c* for applying a cosmetic composition such as mascara to the inner, middle, and outer portion of the eyelashes, respectively. The three ovoid or spherical appearance sections 45*a*, 45*b*, and 45*c* are disposed on the applicator head 40 along the central longitudinal axis Y of the application head 40. The tines 43 vary in length in a row 47 and the longest tines 43 in each ovoid section 45*a*, 45*b*, and 45*c* lie in middle of respective sections 45*a*, 45*b*, and 45*c* and with shorter bristles toward the end of each section 45*a*, 45*b*, and 45*c*, such that each section 45*a*, 45*b*, and 45*c* approximates a sphere-like shape. All tines 43 are regularly spaced in a row 47. The sections 45*a*, 45*b*, and 45*c* are adapted to engage with different portions of a user's eyelashes to improve application of a cosmetic composition. The large section 45*c* has the longest tines and the large section 45*c* is close to proximal end of the core 42. According to a preferred embodiment, the longest tine in medium section 45*b* is smaller in height than the height of longest tine of the large section 45*c* but larger than the longest tine of the small section 45*a*. Such applicator allows for improved application of a cosmetic composition, such as by a single stroke. The large section 45*c* is adapted to engage with the longest eyelashes of the user's eye. The medium section 45*b* is adapted to engage with the medium length eyelashes of a user's eye and similarly the small section 45*a* is adapted to engage with the shortest eyelashes located towards the inner corner of a user's eye. However, the envelope shape is not restricted to tri-lobed profile and the tines 43 may be selected and arranged in different possible manners in order to obtain different envelope shapes known in art.

Figure 6A:
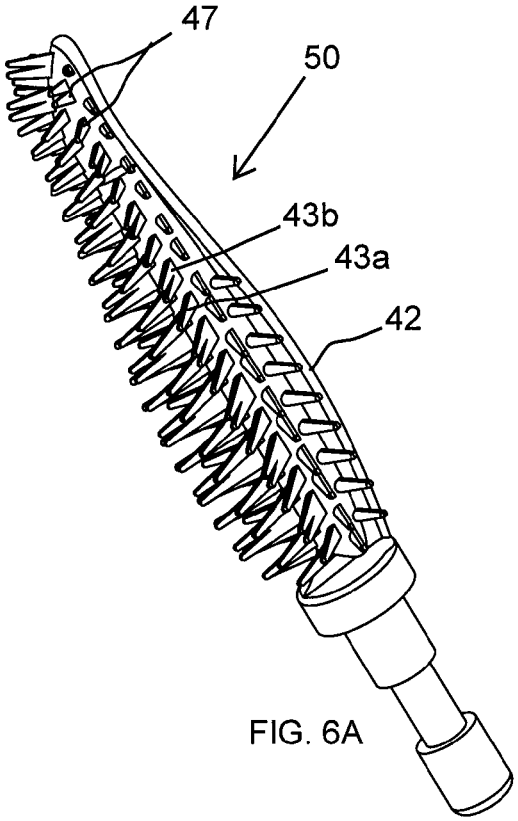
FIG. 6A is a perspective view of an applicator head according to another embodiment of the present disclosure.
Figure 6B:
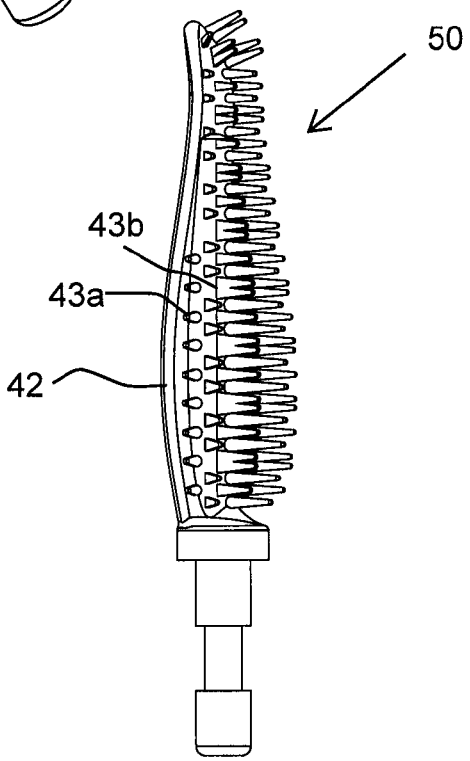
FIG. 6B is a left side view of the applicator head of FIG. 6A.

FIGS. 6A and 6B illustrate an applicator head 50 according to another embodiment of the present disclosure. The applicator head 50 is substantially similar to the applicator head 40 described above, except that, tines are of two different shapes and the envelop shape formed by tines differs. The tines cover the core 42 in a substantially radial configuration and are arranged in plurality of longitudinal rows. At least one row of tines of the applicator head 50 consists of regularly spaced tines 43*a* having a single tip and at least one another row 47 comprising a tine 43*b* having two tips alternating with a tine 43*a* with a single tip with a regular space between them. The tines 43*a* and tines 43*b* vary in length in a row 47.

The applicator head 40 of the disclosure may be formed by a bi-injection molding process. For example, as shown in FIGS. 1, 2A, 3A, 5A and 5B, the bi-injected applicator head 40 comprises two parts, namely a first applicator part 40*a* and a second applicator part 40*b* which are bi-injection molded as a single unit. The process of bi-injection molding is a well known process which allows two or more materials to be substantially simultaneously injected into a single mold to obtain a single integrally formed component. The first applicator part 40*a* and the second applicator part 40*b* may be formed of two different materials. A part of the core 42 and bristles 43 which constitute the first applicator part 40*a* are fabricated using a first material. Similarly, another part of the core 42 and bristles 43 which constitute the second applicator part 40*b* are fabricated using a second material which is different from the first material. The two materials differ in physical and/or chemical properties. The first material and the second material may have different chemical nature or they may have same chemical nature but have different color and/or texture and/or hardness.

As used herein, the term 'same chemical nature' means that the at least two materials may belong to a same family of polymer, for example an elastomer or a thermoplastic elastomer. Within a family they may correspond to polymers obtained from the same monomer or type of monomer, or the same monomers or same type of monomers, being in this case copolymers. The copolymers of the same chemical nature may differ by the special distribution of the monomers, being alternating or statistical copolymers, and/or by the proportions of the monomers in the copolymers. Within a family, the at least two materials may correspond to polymers having a same backbone with different and/or identical lateral chains and/or substituents. Within a family they may correspond to different grades, for example to different degree of cross linking and/or a different degree of polymerization. The at least two materials may differ by their additive(s) and/or plasticizer(s), and/or may comprise a same additive and/or plasticizer in different quantity.

The at least two materials may each comprise the two same polymers, but in different proportions, having different hardnesses. The two materials may be e.g. two polyester, having different hardnesses, for example Hytrel® 40 Shore A and Hytrel.degree. 70 Shore A, for example two polyether block amide such as two different grades of PEBAX®, or two different polyolefins, for example with the same number of carbons, or two different polyamides, for example two grades of Nylon®. The use of at least two materials of the same chemical nature may facilitate the molding of the cosmetic applicator, the compatibility between the at least two materials being greater due to their same chemical nature.

According to another embodiment of the disclosure, the at least two materials may have properties that are attractive and non-attractive to mascara, have different stiffness, have different tactile feel, have different color, have different chemical nature, have different magnetic property, have different temperature property and/or other property.

According to an embodiment of the disclosure, the first applicator part 40*a* is fabricated from the first material which is softer than the second material from which the second applicator part 40*b* is fabricated. In one embodiment, the first applicator part 40*a* is fabricated from the first material having a hardness of less than about 80 Shore D scale (ShD). In another embodiment, the second applicator part 40*b* is fabricated from the second material having a hardness of greater than about 20 Shore D scale (ShD). It is also contemplated that the first material of the first applicator part 40*a* may be harder than the second material of the second applicator part 40*b*. The hard material has been found to provide separation of the lashes during the application of mascara, while the softer material provides lift and volume.

In an alternate embodiment of the present disclosure, the first applicator part 40*a* and the second applicator part 40*b* of the applicator head 40 may be two separate parts which may be coupled together to obtain the applicator head 40 of the present disclosure. The first applicator part 40*a* is coupled to the second applicator part 40*b* may coupled to each other any known affixation means or mechanisms, either mechanical or adhesive-based. The first applicator part 40*a* and the second applicator part 40*b* may be formed of two different materials. The core 42 and bristles 43 which constitute the first applicator part 40*a* are formed by integrally injection-molding using a first material. Similarly, the core 42 and bristles 43 which constitute the second applicator part 40*b* are formed by integrally injection-molding using a second material. The first material and the second material of the first applicator part 40*a* and the second applicator part 40*b* respectively may have properties that are attractive and non-attractive to mascara, have different hardness, have different tactile feel, have different color, have different chemical nature, have different magnetic property, have different temperature property and/or other property.

According to an alternate embodiment of the present disclosure, the applicator head 40 including the core 42 and the tines 43 may be a single piece obtained by injection molding of a single material.

According to an alternate embodiment of the present disclosure, the applicator head 50 may be made by bi-injection molding using two different materials or by a single injection molding using a single material.

According to an alternate embodiment, the tines 43, 43*a*, and 43*b* may be covered by a flock coating (not shown). In another alternate embodiment of the present disclosure, at least some of the tines 43, 43*a* and 43*b* of at least one of the applicator parts 40*a* or 40*b* may be flocked (not shown).

In the embodiment under consideration, the core 42 and tines 43, 43*a* and 43*b* may be molded using any suitable material, for example a plastic material, such as thermoset materials or a thermoplastic polyester elastomer, a thermoplastic polyurethane elastomer, or compound thermoplastic materials including SBS or SEBS. Molding materials may also include antibacterial agents, for example Triclosan® and/or product performance-enhancing and/or shelf-life-enhancing agents, such as plasticizers to improve flexibility and reduce the occurrence of cracking over time, and fluorination agents to provide a barrier layer over hygroscopic plastics.

Although the present disclosure has been described herein with reference to particular embodiments, it is to be understood that these embodiments are merely illustrative of certain principles and applications of the present disclosure. It is further to be understood that numerous modifications may be made to the illustrative embodiments and that other arrangements may be devised without departing from the present disclosure.

What is claimed is:

1. A cosmetic applicator comprising:

a rod having a central longitudinal axis;

an applicator head attached to a distal end of the rod, the applicator head comprises a core and a plurality of application elements projecting outwardly from the core;

wherein the core is elongated along a central longitudinal axis;

wherein the central longitudinal axis of the core does not coincide or intersect with the central longitudinal axis of the rod;

wherein the core has a non-circular and variable transverse cross-section over a major portion of its length;

wherein the core includes at least one spline running along entire length of the core and wherein a proximal end of the spline contacts an outer edge of a transition portion of the applicator head;

wherein the spline has a curvature comprising only a single convex curve followed by a single concave curve;

wherein the single convex curve extends along more than half a length of the spline from the proximal end of the spline towards a distal end of the spline;

wherein the single concave curve extends along at least one-fourth of the length of the spline from the distal end of the spline towards the proximal end of the spline; and wherein the spline is free of application elements.

2. A cosmetic applicator according to claim 1, wherein the spline has a width that gradually reduces from a proximal end towards a distal end of the applicator head and wherein the width of the spline at any portion of the core is always less than half of value of a perimeter of the core at said portion of the core.

3. A cosmetic applicator according to claim 1, wherein a radius of curvature of the single convex curve of the spline is greater than a radius of curvature of the single concave curve.

4. A cosmetic applicator according to claim 1, wherein the plurality of application elements are selected from a group consisting of tines, bristles, fibers and flock.

5. A cosmetic applicator according to claim 1, wherein the transition portion of the applicator head has a similar cross-section as that of the rod.

6. A cosmetic applicator according to claim 1, wherein the central longitudinal axis of the core comprises at least two concave curvatures that are opposite in direction to each other so as to impart an s-shaped curvature to the central longitudinal axis of the core.

7. A cosmetic applicator according to claim 1, wherein the core has a bi-lateral symmetry and wherein transverse cross sections of the core do not have a radial symmetry.

8. A cosmetic applicator according to claim 1, wherein the cosmetic applicator includes a first face and a second face opposite to the first face, and wherein the first face is an application face and comprises application elements, and wherein the second face is free of application elements.

9. A cosmetic applicator according to claim 1, wherein the plurality of application elements is in form of tines and wherein the tines are arranged in longitudinal rows in a manner such that an envelope shape formed by tips of the tines has a tri-lobed profile.

10. A cosmetic applicator according to claim 9, wherein the tines of one row alternate with the tines of adjacent row in longitudinal direction of the core.

11. A cosmetic applicator according to claim 1, wherein the applicator head comprises a first applicator part and a second applicator part, and wherein the first applicator part comprises a part of the core along with the plurality of application elements thereon, and the second applicator part comprises another part of the core along with the plurality of application elements thereon.

12. A cosmetic applicator according to claim 11, wherein the first applicator part and the second applicator part are made of different materials.

13. A cosmetic applicator according to claim 12, wherein the first applicator part and the second applicator part are formed by a bi-injection molding process as a single unit.

14. A cosmetic applicator according to claim 11, wherein the first applicator part and the second applicator part of the applicator head are two separate parts that are coupled together mechanically.

15. A cosmetic applicator according to claim 12, wherein the materials of the first applicator part and the second applicator part differ in one of their physical and/or chemical properties.

16. A cosmetic applicator comprising:

a rod having a central longitudinal axis;

an applicator head attached to a distal end of the rod, the applicator head comprises a core and a plurality of application elements projecting outwardly from the core;

wherein the core is elongated along a central longitudinal axis;

wherein the central longitudinal axis of the core does not coincide or intersect with the central longitudinal axis of the rod;

wherein the core includes at least one spline running along the entire length of the core and wherein a proximal end of the spline contacts an outer edge of a transition portion of the applicator head;

wherein the spline is free of application elements;

wherein the spline has a curvature comprising only a single convex curve followed by a single concave curve;

wherein the single convex curve extends along more than half a length of the spline from the proximal end of the spline towards a distal end of the spline;

wherein the single concave curve extends along at least one-fourth of the length of the spline from the distal end of the spline towards the proximal end of the spline; and wherein the core has a thickness that increases and then decreases, from a proximal end of the core towards a distal end of the core, and defines a maximum thickness at about one third of the length of the core.

17. A cosmetic applicator according to claim 16, wherein a width of the spline at any portion of the core is always less than half of value of a perimeter of the core at said portion of the core.

18. A cosmetic applicator comprising:

a rod having a central longitudinal axis;

an applicator head attached to a distal end of the rod, the applicator head comprises a core and a plurality of application elements projecting outwardly from the core;

wherein the core is elongated along a central longitudinal axis;

wherein the central longitudinal axis of the core does not coincide or intersect with the central longitudinal axis of the rod;

wherein the core has a non-circular and variable transverse cross-section along a major portion of its length;

wherein the core includes at least one spline running along the entire length of the core and wherein a proximal end of the spline contacts an outer edge of a transition portion of the applicator head;

wherein the spline has a curvature comprising only a single convex curve followed by a single concave curve;

wherein the single convex curve is a smooth curve free of any sharp edge;

and wherein the spline is free of application elements.

19. A cosmetic applicator according to claim 18, wherein the applicator head comprises a first applicator part and a second applicator part;

wherein the first applicator part is made of a material different than a material of the second applicator part;

wherein the first applicator part comprises a part of the core along with application elements thereon, said part of the core also includes the spline;

wherein the second applicator part comprises another part of the core along with application elements thereon.

20. A cosmetic applicator according to claim 18, wherein a width of the spline at any portion of the core is always less than half of value of a perimeter of the core at said portion of the core.

* * * * *